US005101751A

United States Patent [19]

Kobayashi

[11] Patent Number: 5,101,751

[45] Date of Patent: Apr. 7, 1992

[54] STEERING ARRANGEMENT FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 457,553

[22] Filed: Dec. 27, 1989

[30] Foreign Application Priority Data

Dec. 28, 1988 [JP] Japan ..... 63-333768

[51] Int. Cl.[5] ..... B63H 25/00

[52] U.S. Cl. ..... 114/144 R; 74/480 B; 244/229; 280/775

[58] Field of Search ..... 114/144 R; 74/480 B, 74/492, 495, 504; 244/229, 234; 440/42, 53; 280/87, 775

[56] References Cited

U.S. PATENT DOCUMENTS

| | | | |
|---|---|---|---|
| 2,436,153 | 2/1948 | Sanmori | 114/144 R |
| 2,614,438 | 10/1952 | Garmon | 114/144 R |
| 2,629,356 | 2/1953 | Whiting | 114/144 R |
| 2,839,312 | 6/1958 | Barenyi et al. | 280/87 |
| 3,675,612 | 7/1972 | Pfeiffer | 440/42 |
| 4,299,407 | 11/1981 | Simson | 280/775 |
| 4,531,921 | 7/1985 | Teraura | 440/53 |

FOREIGN PATENT DOCUMENTS

| | | |
|---|---|---|
| 998391 | 1/1952 | France . |
| 883130 | 11/1961 | United Kingdom . |
| 1082380 | 9/1967 | United Kingdom . |

*Primary Examiner*—Jesus D. Sotelo
*Attorney, Agent, or Firm*—Ernest A. Beutler

[57] ABSTRACT

A small watercraft of the jet propulsion type having a cockpit that is adapted to accommodate either one or two riders. When one rider is accommodated he may sit in the center of the seat and operate the watercraft from the center thereof. When two riders are positioned, one may be the operator and may operate the watercraft from one side thereof. To permit this, a steering control is disclosed that is moveable between either a central or side position.

6 Claims, 6 Drawing Sheets

STEERING ARRANGEMENT FOR SMALL WATERCRAFT

BACKGROUND OF THE INVENTION

This invention relates to a steering arrangement for a small watercraft and more particularly to an improved steering arrangement that permits the operator to steer the vessel from one location when the watercraft is loaded in one way and in another location when the watercraft is loaded another way and also to a hull construction for a small watercraft that permits such varied loading.

There is a very popular type of small watercraft that is designed primarily to be operated by a single rider. When a small displacement hull is used and the watercraft is designed to be operated only with a single rider, certain problems can arise if the operator wishes to carry a passenger with him. For example, if the watercraft is designed to be operated by a single rider seated in straddle fashion as in common practice, the additional of a passenger behind the rider will change the fore and aft trim condition of the watercraft. This problem is relatively easily accommodated because the operator may move forwardly when the added rider is in position so that the fore and aft balance of the watercraft will remain substantially the same.

However, there are many instances when it is desirable to permit the passenger to sit next to the driver or operator rather than behind him. This raises a considerably different problem. If the watercraft is designed to balanced with the operator sitting in one position and a rider assumes a position in the watercraft next to the operator, the watercraft will heel to one side or the other. Although this may be accommodated by the operator shifting his position to one side of the watercraft, then the control of the watercraft can be difficult or awkward.

It is, therefore, a principal object of this invention to provide a control arrangement for a small watercraft that permits the operator to control the watercraft from one position when he is the only passenger in the watercraft and in another position when a passenger is seated along side of him.

It is a further object of this invention to provide a steering arrangement for a small watercraft wherein the operator may steer the watercraft from either of two laterally displaced positions depending upon whether he is alone or accompanied by a passenger.

It is still further object of this invention to provide an improved, versatile steering arrangement for a small watercraft.

It is a further object of this invention to provide a small watercraft construction of the type that permits the watercraft to be stable in both fore and aft and lateral directions whether occupied by only a single rider or if it is occupied by the rider and one or more passengers.

SUMMARY OF THE INVENTION

A first feature of this invention is adapted to be embodied in a small watercraft providing a rider's compartment having a seat having sufficient width so as to permit the operator to operate the watercraft from either a centrally located position or from one side of the watercraft with a rider or passenger seated next to him. A control mechanism is provided for operation by the operator and is moveable between a centrally located position and a side located position depending upon whether the operator is the only passenger in the watercraft or whether he has a further passenger with him and which permits the watercraft to be operated by the operator at either position.

Another feature of this invention is adapted to be method in a small watercraft having a hull defining a passenger's compartment having a seating arrangement affording a seating position for a single rider, operator positioned centrally of the watercraft or a pair of riders seated in side by side fashion. A control arrangement for the watercraft is also incorporated that permits the driver to operate the watercraft from either the centrally located position or the side located position.

DETAILED DESCRIPTION OF THE PREFERRED EMBODIMENT OF THE INVENTION

Figure 1:
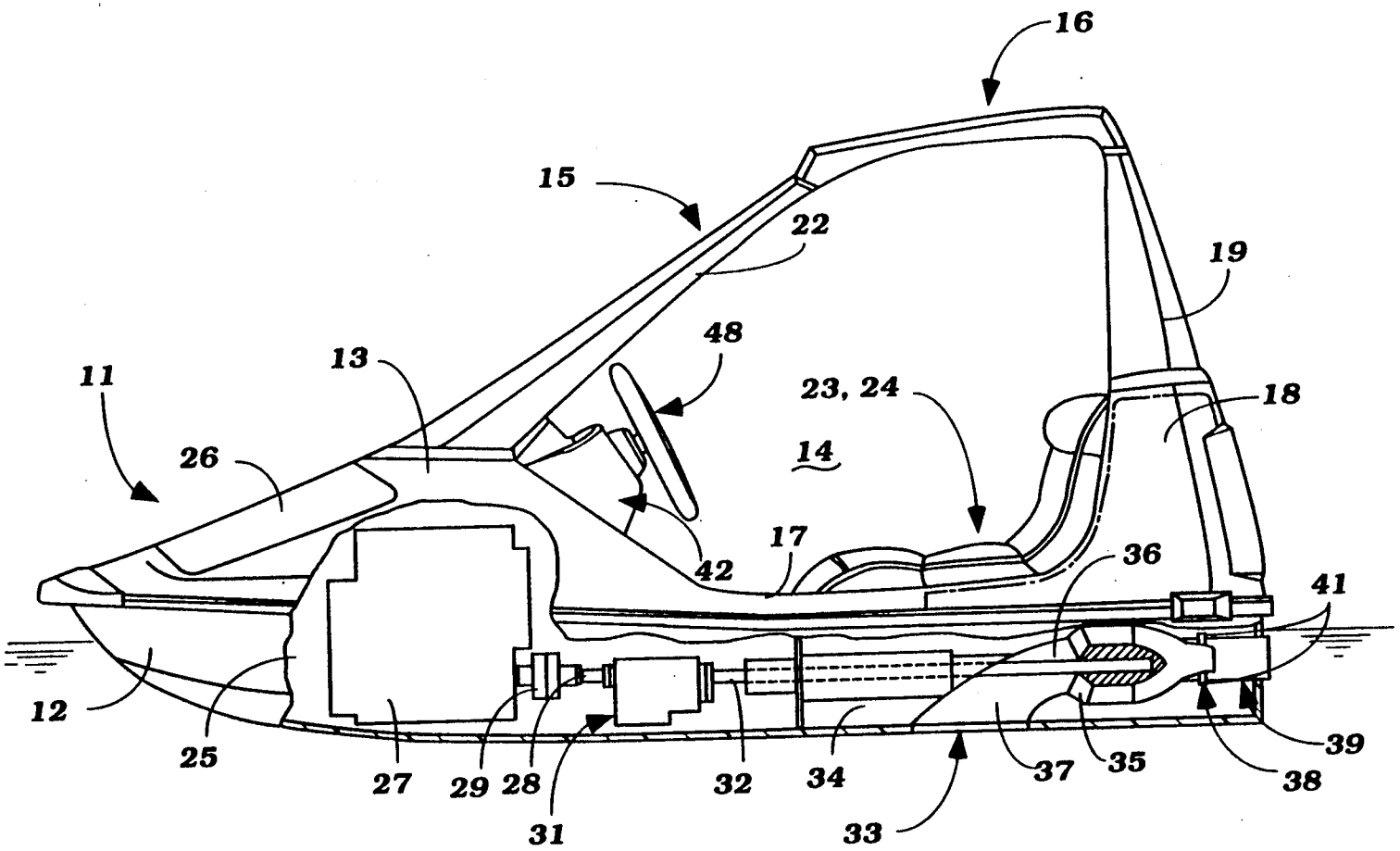
FIG. 1 is a side elevational view of a small watercraft constructed in accordance with an embodiment of the invention, with a portion broken away and other portions shown in sections.
Figure 2:
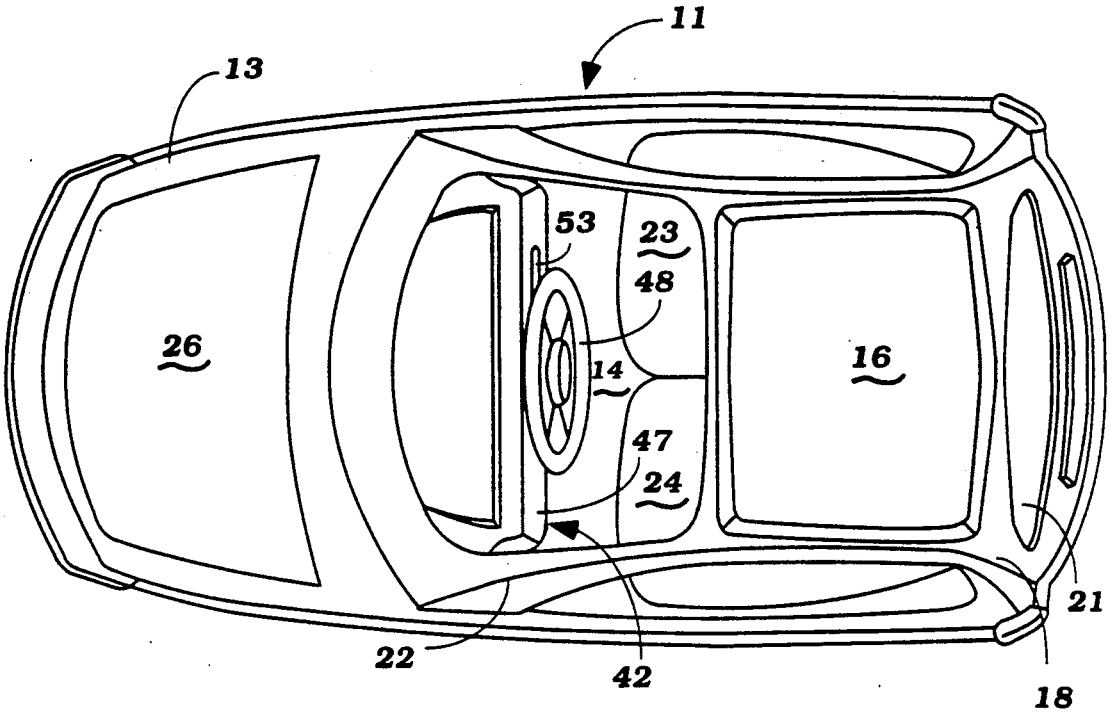
FIG. 2 is a top plane view of the watercraft.
Figure 3:
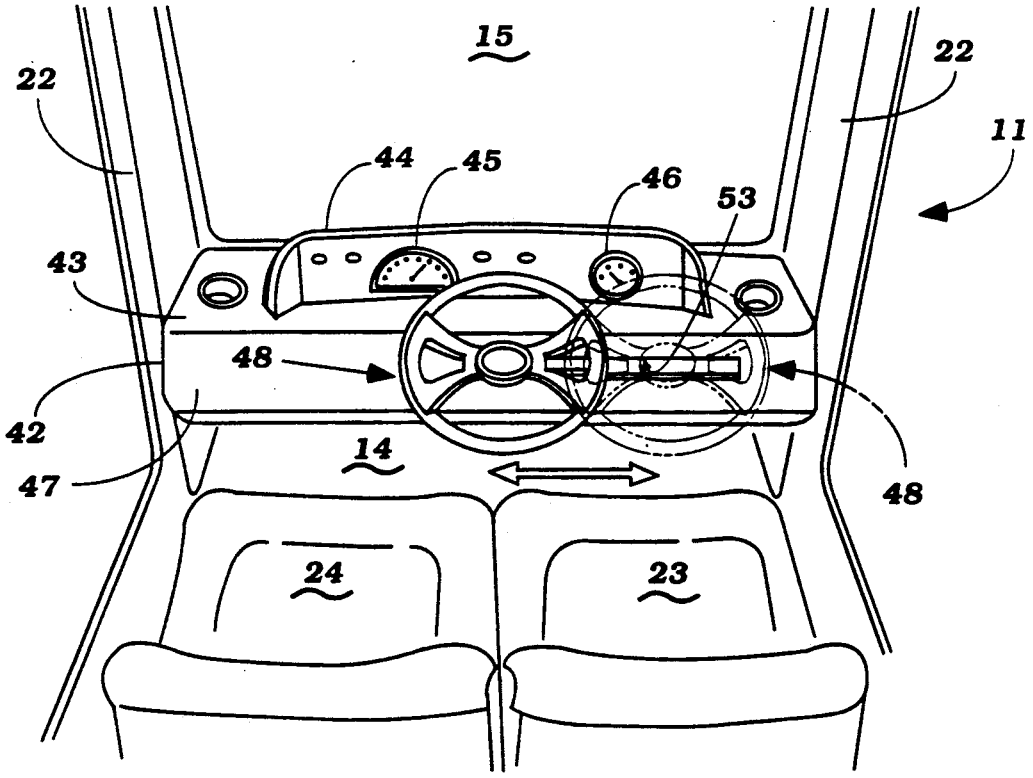
FIG. 3 is a perspective view of the passenger compartment from the rear and above showing the steering mechanism in its position when there is a single operator in the watercraft in solid line and in the position there is the operator and a passenger, in phantom.

Referring in detail to the drawings and initially primarily to FIGS. 1 through 3, a small watercraft constructed in accordance with an embodiment of the invention is identified generally by the reference numeral 11. The small watercraft 11 is comprised of a hull assembly made up of a lower, hull portion 12 and an upper, deck portion 13. The hull portion 12 and deck portion 13 may be conveniently formed from a molded fiberglass reinforced resin although other materials may be utilized in conjuction with the invention.

The hull portion 12 and deck portion 13 cooperate together to form a rearwardly positioned passenger compartment, indicated generally by the reference numeral 14. The passenger compartment 14 is defined at least in part by a rearwardly slanted windshield 15 that may support the upper and forward end of a roof 16. The deck portion 14 is provided with a pair of cutaway side parts 17 that afford access to the passenger compartment 14 and which terminate in an upwardly extending rear portion 18. Rear roof support 19 support the rear of the roof 16 from the section 18. The rear roof support 19 may be a single component that defines a rear window opening 21.

The windshield 15 may be of the frameless type or may include a center pane of glass that is supported by a pair of upstanding windshield posts 22 that form at least in part the structural support for the forward portion of the roof 16.

Within the passenger compartment 14 there is provided either a single bench type seat or a pair of adjacent bucket type seats 23 and 24. The seats 23 and 24 are provided with both cushion portions and back rest portions with the back rest portions being nested between the rear deck portion 18. As a result, the seating position of the occupants of the passengers compartment 14 are at the extreme rear end of the watercraft.

The forward portion of the hull portion 12 and deck portion 13 define an engine compartment area 25 that is accessible through a removable hatch cover 26 which forms a part of the deck portion 13. An internal combustion engine 27, of any known type may be positioned within the engine compartment 25 and drives an output shaft 28 through a flexible coupling 29. The output shaft 28 is, in turn, connected to a self cleaning transmission mechanism, indicated generally by the reference numeral 31 and having a construction as best described in my co-pending application entitled "Cleaning Arrangement For Water Jet Propulsion", Ser. No. 457,552, filed Dec. 27, 1989 and assigned to the Assignee of this application. That disclosure is incorporated herein by reference and, therefore, further description of this mechanism is not believed to be necessary.

It is to be understood, however, that the mechanism 31 normally drives an output shaft 32 in a forward drive direction. The output shaft 32 may, however, selectively be reversed in direction of rotations for self cleaning of a jet propulsion unit, indicated generally by the reference numeral 33, in selected forward or reverse directions for normal drive or self cleaning purposes as described in my noted co-pending application.

The hull portion 12 defines a rearwardly positioned tunnel or recess 34 in which the jet propulsion unit 33 is positioned. The jet propulsion unit 33 includes an impeller 35 that is affixed to an impeller shaft 36 which is, in turn, driven by the self cleaning transmission output shaft 32.

The impeller 35 draws water through a downwardly facing water inlet 37 and discharges it through a discharge nozzle 38 and steering and discharge nozzle 39. The steering and discharge nozzle 39 is supported for pivotal movement about a generally vertically extending axis relative to the main discharge nozzle 38 by means of pivot pins 41 for steering the watercraft 11 in a manner now to be described.

As has been noted, the seating arrangement for the watercraft permits the watercraft to be operated by a single rider, driver, or to be occupied by the rider, driver and one passenger. If the watercraft is operated by only a single rider, driver, that individual should sit centrally in the watercraft so as to avoid heeling from one side to the other. If the watercraft is balanced so that when the single rider, operator sits in the seat 23, then if a passenger occupies the seat 24, the watercraft 11 will obviously heel to the left. Therefore, it is desirable to provide an arrangement wherein the watercraft can be operated centrally of the seats 23 and 24 when there is only a single rider, operator or from one side thereof when a passenger is also in the passengers compartment 14. The arrangement, now to be described, affords such an operation of the watercraft.

A dashboard 42 is carried by the deck portion 13 and extends across the forward portion of the passenger compartment 14 at the base of the windshield 15. The dashboard 42 has an upper shelf 43 from which extends a display panel 44 that may contain some controls for the watercraft and gauges such as a water speed indicator 45 and fuel level gauge 46.

In addition, the dashboard 42 has a generally vertically extending face 47 from which extends a steering wheel 48. The steering wheel 48 is coupled to a steering gear box assembly, indicated generally by the reference numeral 49 and shown in most detail in FIGS. 4 through 8. The steering gear box assembly 49 and steering wheel 48 are supported for movement transversely across the dashboard 42 in a manner to be described so as to permit the steering wheel 48 to be positioned centrally as shown in FIG. 2 and the solid line views of FIGS. 3 and 4 wherein the watercraft may be steered by an operator seated centrally on the seats 23 and 24 or to a side position, as shown in phantom in FIGS. 3 and 4, wherein the watercraft 11 may be steered by the operator seated on the seat 23.

The construction by which the steering wheel 48 and steering gear assembly 49 is supported for such movement and can be locked in the respective positions will now be described by particular reference to FIGS. 4 through 8. It should be noted that the dashboard assembly 42 is formed from molded fiberglass reinforced resin like the hull portion 12 and deck portion 14. There is provided within a channel shape of the dash panel 42 a reinforcing I-beam 51 which is supported on a lower lip 52 of the dash panel 42. The dash panel face 47 and I-beam 51 are formed with a transversely extending slot 53 through which a hub portion 54 of the steering gear 49 extends. The hub portion 54 journals a steering shaft, indicated generally by the reference numeral 55, which has a splined end portion 56 onto which the hub of the steering wheel 48 is affixed by means of a nut 57 and washer 58 (FIG. 7). As a result, rotation of the steering wheel 48 will effect rotation of the steering shaft 55.

The lower end of the steering shaft 56 is threaded as at 59 and receives a sector gear assembly, indicated generally by the reference numeral 61 and which has a hub portion 62. A lock nut 63 serves to lock the sector gear 61 for rotation with the steering shaft 55.

The steering gear assembly 49 includes a housing 64 which is closed by a suitable cover plate that forms the hub position 45. An angle assembly 65, which may be formed as an extrusion, provides a track 67 and is affixed transversely across the housing 64 in a suitable manner. A gear rack indicated generally by the reference numeral 68 has rack like teeth 69 which are engaged with the teeth of the sector gear 61. In addition, the rack has a groove 71 that is complimentarily to the track 67 and which slideably supports the rack 68 for transverse movement along the track 67.

The rack 68 is provided with a tapped opening 72 in which the threaded post of a spherical connector 73 is received. The spherical connector 73 has a spherical portion 74 that provides a universal connection to a connector 75. The connector 75 is, in turn, threaded on to a threaded rod 76 of the Bowden wire actuator of a Bowden wire assembly, indicated generally by the reference numeral 77. The sheath of the Bowden wire assembly 77 is affixed relative to the angle 65 and its track 67 by means of a block type retainer having a base portion 78 and a cover portion 79 that are affixed to each other so as to clamp the sheath in position.

Figure 4:
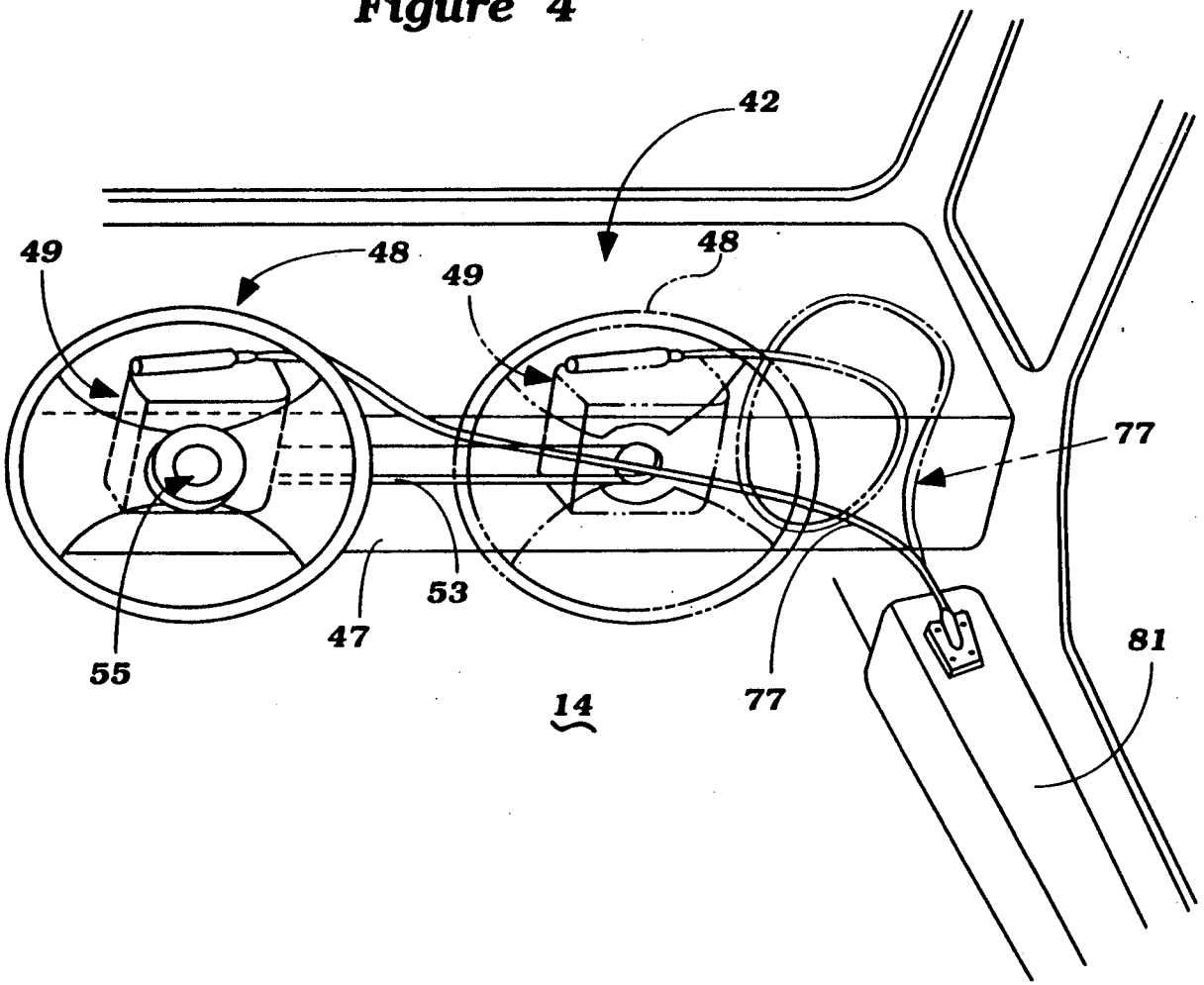
FIG. 4 is a further enlarged perspective view from the rear and to the left of the passenger compartment showing interrelationship between the steering wheel and the steering mechanism in each position of the steering wheel.

As may be seen in FIG. 4, the Bowden wire assembly 77 extends from behind the dash panel 42 to a control housing 81 that extends along one side of the passenger compartment 14. The wire actuator is, at the opposite end, connected to a lever (not shown) affixed to the steering nozzle 39 so as to rotate the steering nozzle 39 and steer the watercraft 11 upon rotation of the steering wheel 48 in a manner which is believed to be readily apparent.

A headed pin 82 (FIG. 6) is affixed to one end of the steering gear housing 64 and is received within a track 83 affixed to the underside of the channel 51. The cooperation of the headed pin 82 with a slot formed in the track 83 and of the hub portion 54 with the slot 53 confines the movement of the steering wheel 48 and steering gear 49 along the aforedescribed path between a position centrally of the passenger compartment 14 and to one side of it.

Figure 5:
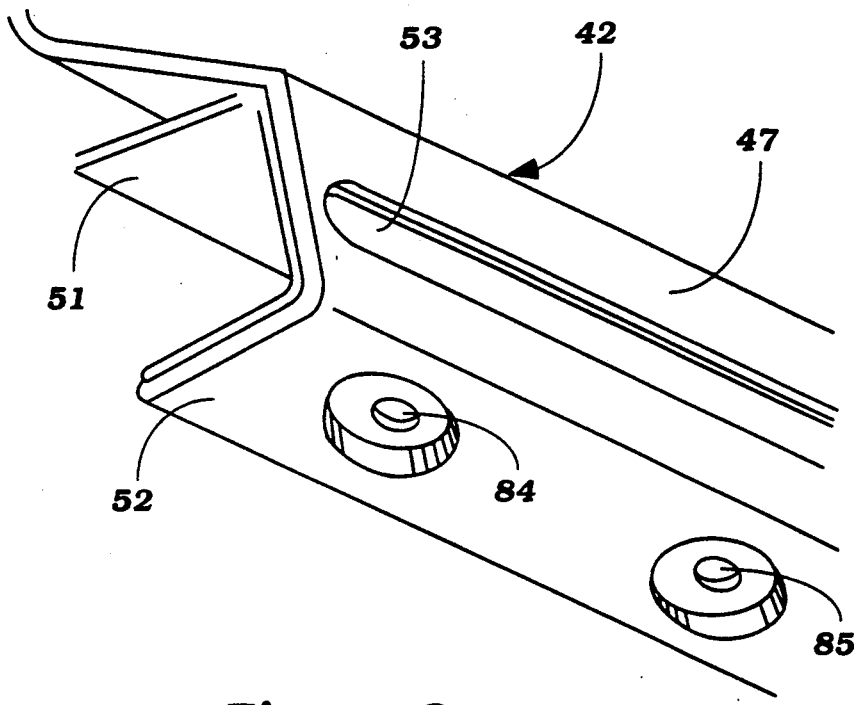
FIG. 5 is a perspective view showing the dashboard of the watercraft from the underside and to the left.
Figure 6:
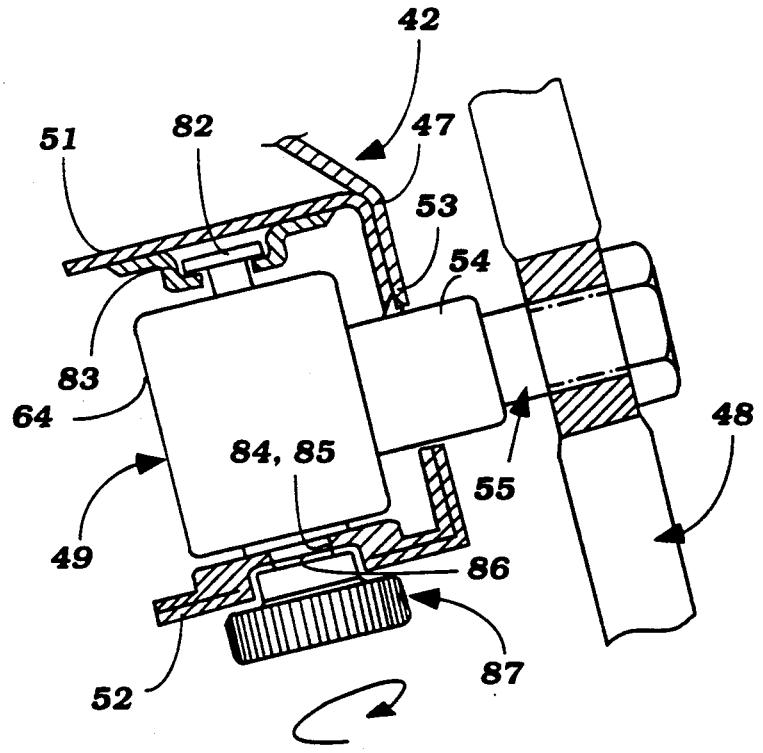
FIG. 6 is a cross sectional view of the dashboard and steering mechanism showing the steering mechanism in one position.
Figure 7:
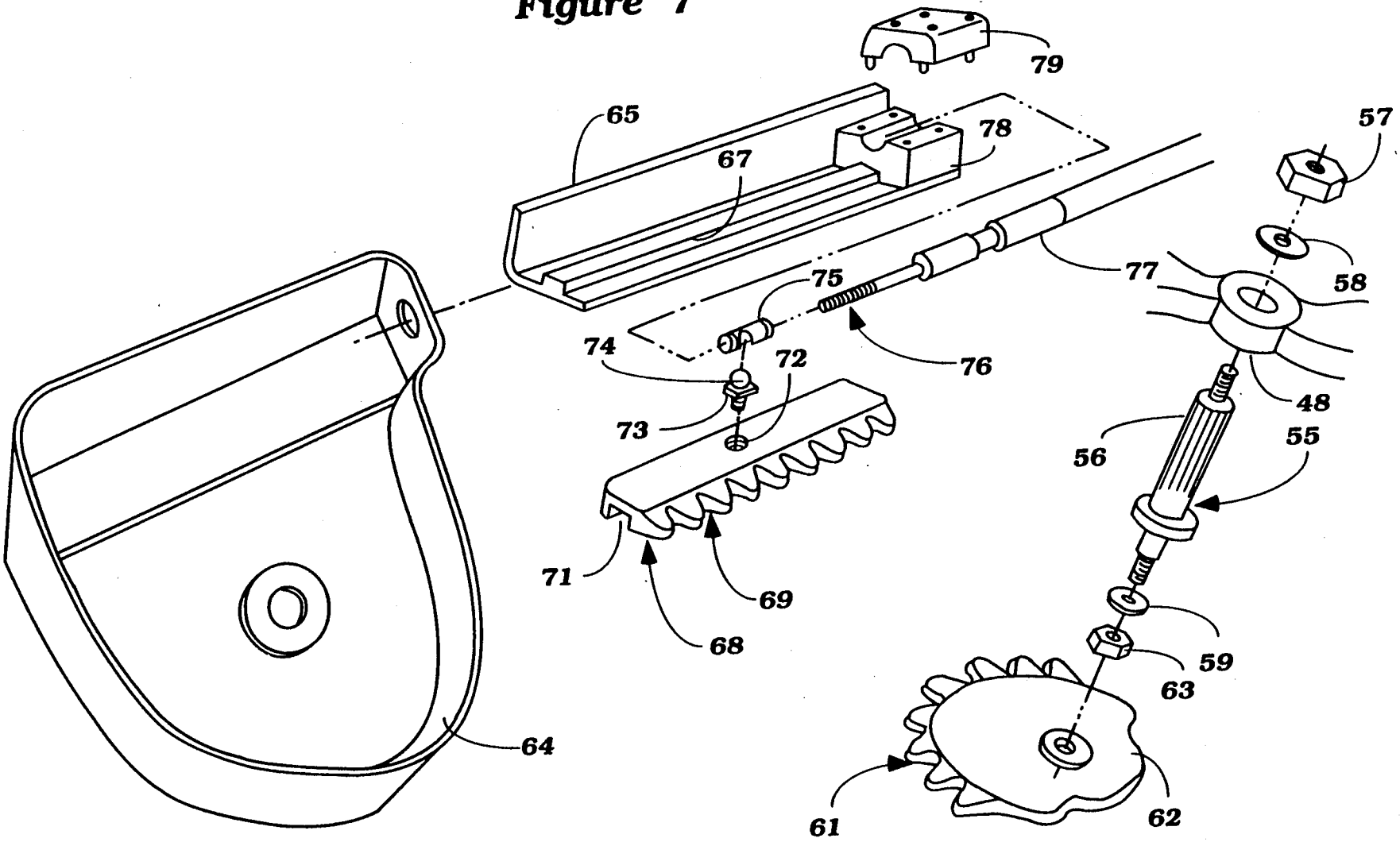
FIG. 7 is an enlarged, exploded perspective view showing the steering mechanism.
Figure 8:
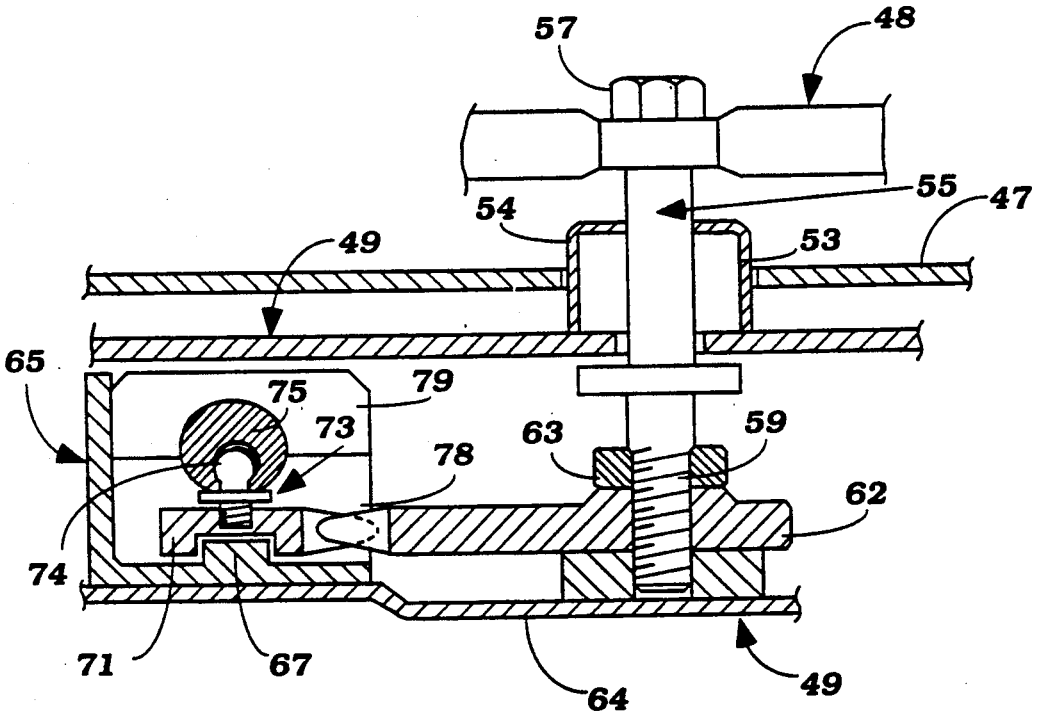
FIG. 8 is a cross sectional view showing the steering mechanism.

A locking mechanism, shown test in FIGS. 5 and 6, is provided for locking the steering mechanism in either position. This locking mechanism is comprised of a pair of transversely spaced apart holes 84 and 85 formed in the underside of the dash lip 52 and the channel 51. The holes 84 and 85 are adapted to received a threaded shaft 86 of a locking knob, indicated generally by the reference numeral 87. This threaded shaft is threaded into a tapped hole formed in the bottom of the housing 64 and will lock the housing 64, steering gear 49 and steering wheel 48 in either of the two adjusted positions.

As may be seen in FIG. 4, the Bowden wire assembly 77 has sufficient length so as to permit the steering mechanism to move between either position without interfering with the steering operation. The slack will coil behind the dashboard 42 when the steering assembly including the steering wheel 48 and steering gear 49 is moved to the extreme right hand position. If desired, the slot 53 and locking mechanism described may also be extended so that the steering wheel 48 and steering gear 49 can be accessible from the seat 24.

In the construction as thus far described, the watercraft 11 was propelled by a jet propulsion unit. It is to be understood, of course, that the invention may be also utilized in conjunction with watercraft having other forms of propulsion mechanisms. The invention, however, has particular utility in conjuction with jet propelled watercraft and particularly those of the type that are steered by dirigibly supported steering nozzles.

It is to be understood that the foregoing description is that of a preferred embodiment of the invention and, althrough certain of modifications have been described, that various other changes and modifications may be made without departing from the spirit and scope of the invention, as defined by the appended claims.

I claim:

1. A small watercraft having a hull providing a rider's compartment having a seat of sufficient width so as to permit an operator to operate said watercraft from either a centrally located position or from one side of said watercraft with a rider or passenger seated next to him, a propulsion unit for said watercraft, a control mechanism provided for operation by the operator and connected by means of a Bowden wire to a control device for said propulsion unit of said watercraft for operating said control device at all times as such control mechanism is operated, means supporting said control mechanism for movement between a centrally located position and a side located position depending upon whether the operator is the only passenger in the watercraft or whether he has a further passenger with him for permitting said watercraft to be operated by the operator in either position, the connection of said control mechanism to said control device including said Bowden wire permiting such position movement of said control mechanism without effecting operation of said control device in response to said position movement.

2. A small watercraft as set forth in claim 1 wherein the control mechanism controls the steering of the watercraft.

3. A small watercraft as set forth in claim 2 wherein the propulsion unit comprises a jet propulsion unit and is steered by a pivotally supported steering nozzle controlled by the control mechanism.

4. A small watercraft as set forth in claim 1 further including a dash panel extending across the rider's compartment and wherein the control mechanism is slidably supported by the dash panel and further including locking means for cooperating with the dash panel and the control mechanism for locking the control mechanism in either of its positions.

5. A small watercraft as set forth in claim 4 wherein the control mechanism controls the steering of the watercraft.

6. A small watercraft as set forth in claim 5 wherein the propulsion unit comprises a jet propulsion unit and is steered by a pivotally supported steering nozzle controlled by the control mechanism.

* * * * *